US006450134B1

(12) United States Patent
Del Sole

(10) Patent No.: US 6,450,134 B1
(45) Date of Patent: Sep. 17, 2002

(54) ADJUSTABLE ENGINE TEMPERATURE REGULATOR

(76) Inventor: Robert Joseph Del Sole, 86 Valley Rd., Larchmont, NY (US) 10538

( * ) Notice: Subject to any disclaimer, the term of this patent is extended or adjusted under 35 U.S.C. 154(b) by 0 days.

(21) Appl. No.: 09/792,511

(22) Filed: Feb. 24, 2001

Related U.S. Application Data

(60) Provisional application No. 60/188,813, filed on Mar. 13, 2000.

(51) Int. Cl.[7] ..... F01P 7/14
(52) U.S. Cl. ..... 123/41.1; 123/41.08
(58) Field of Search ..... 123/41.1, 41.08; 251/298, 299, 300, 301

(56) References Cited

U.S. PATENT DOCUMENTS 1,187,535 A * 6/1916 LaPorte ..... 123/41.1
5,505,164 A * 4/1996 Hollis ..... 123/41.1
5,555,865 A * 9/1996 Kim ..... 123/184.56
5,799,625 A * 9/1998 Ziolek et al. ..... 123/41.1
6,032,618 A * 3/2000 Ferrari et al. ..... 213/41.1
6,109,219 A * 8/2000 Sano ..... 123/41.1

* cited by examiner

*Primary Examiner*—Noah P. Kamen
*Assistant Examiner*—Jason Benton

(57) ABSTRACT

Temperature control for a liquid cooled internal combustion engine having a radiator through which liquid is circulated from a hose having a circular liquid passage orifice of a specified diameter. The temperature of the engine after being dully warmed up has a minimum value when the orifice is unobstructed and full open, the engine temperature increasing as the opening in the orifice is restricted and decreased. An internal rotating blade in slidable engagement with the orifice can assume any position with respect to the orifice between a minimum position at which the rotating blade produces a minimum restriction of the orifice and a maximum position at which the rotating blade produces a maximum restriction of the orifice. A manually operated device connected to the rotating blade places the rotating blade in any desired position between minimum and maximum positions.

4 Claims, 4 Drawing Sheets

ADJUSTABLE ENGINE TEMPERATURE REGULATOR

CROSS REFERENCE TO COPENDING APPLICATION

This patent application is related to Provisional Application Ser. No. 60/188,813 filed on Mar. 13, 2000.

BACKGROUND OF THE INVENTION

Vehicles employing liquid cooled internal combustion engines as power sources have radiators through which the liquid is circulated from a hose having a circular water passage orifice. In order to maintain a suitable engine operating temperature, an engine thermostat having a preset temperature installed in the orifice to regulate the temperature by limiting the liquid flow through the cooling system. Typically, the thermostat incorporates a heat sensitive bimetal coil which reacts to the liquid coolant temperature by opening or closing the thermostat to allow or prevent circulation of liquid in order to establish and maintain the preset temperature.

Engines used in racing cars cannot use thermostats. Thermostats are not reliable because they can stick in a closed or open position creating either an overheating condition which can damage the engine or diminish engine performance. Instead, the thermostat is replaced by a cooling device known as a restrictor plate which is used in place of the bimetallic element. This device is a circular disk with a pre sized central opening. The size of the opening determines the pre set temperature. Changing the diameter of the central opening of the disk changes the operating temperature.

However, while disk changes can be made easily when the engine is cold and at rest, it is hazardous, difficult and time consuming to replace one disk with another while the engine is hot and such replacement cannot take place during a race. A skilled driver of a racing car may wish to change the operating temperature during a race because of ambient temperature, track and race condition changes during a race.

The present invention is directed toward a new type of temperature regulator which under manual operation of a racing car driver enables the operating temperature of an engine to be changed as desired during a race.

SUMMARY OF THE INVENTION

It is the primary object of this invention to provide a new type of temperature regulator which can be used to rapidly change the operating temperature of a liquid cooled internal combustion engine while the engine is hot.

Another object of this invention is to provide toward a new type of temperature regulator which under manual operation of a racing car driver enables the operating temperature of an engine to be changed as desired during a race.

Yet another object is to provide a new type of temperature regulator of the character indicate which is inexpensive, durable, and easy to install and maintain.

The invention employs a liquid cooled internal combustion engine having a radiator through which liquid is circulated from a hose having a circular liquid passage orifice of a specified diameter. The temperature of an engine after being fully warmed up has a minimum value when the orifice is unobstructed and is fully open, the engine temperature increasing as the opening in the orifice is restricted and decreased. In accordance with the principles of the invention, an internal rotating blade is placed in slidable engagement with the orifice. The rotating blade can assume any position with respect to the orifice between a minimum position at which the rotating blade produces a minimum restriction of the orifice and a maximum position at which the rotating blade produces a maximum restriction of the orifice. A manually operated means is connected to the rotating blade to place the rotating blade in any desired position between minimum and maximum positions.

This means includes a adjusting screw secured to the rotating blade which when turned actuates the rotating blade over the orifice. The position of the rotating blade is determined by suitable rotation of the adjusting screw. One end of a cable is affixed to the adjusting screw the other end of the cable can be disposed on the dash board of a racing car to enable the driver to rotate the adjusting screw through the cable and set the temperature as desired.

Typically, the orifice has a diameter of about one inch and the minimum and maximum temperatures can be 140 degrees and 260 degrees respectively.

BRIEF DESCRIPTION OF THE DRAWING

In the accompanying drawing which forms a part of the specification.

REFERENCE NUMERALS IN DRAWINGS

Figure 1:
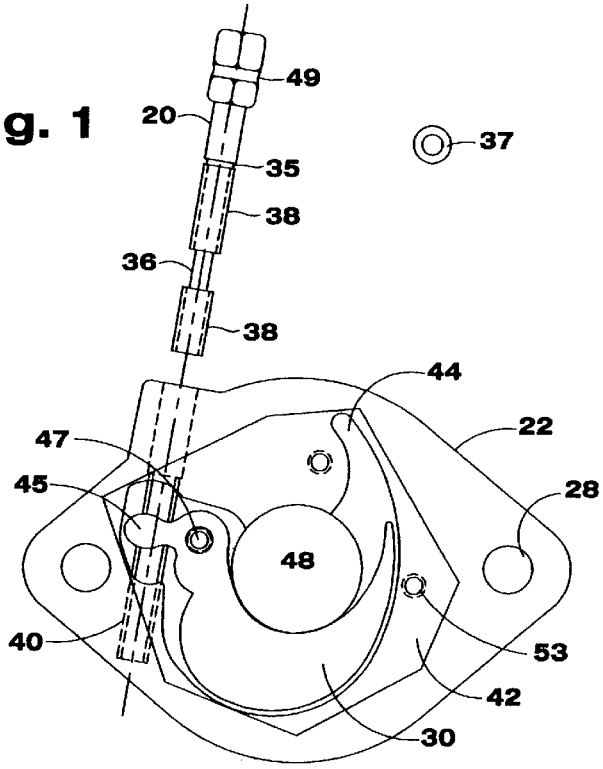
FIG. 1 is a top view of the temperature regulator with the cover plate removed showing the rotating plate the adjusting screw and the o-ring seal.
Figure 2:
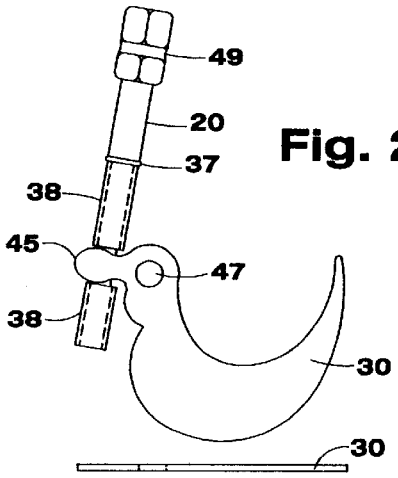
FIG. 2 is a top view of the adjusting screw with the o-ring installed and the rotating plate in place, also shown is a side view of the rotating plate
Figure 3:
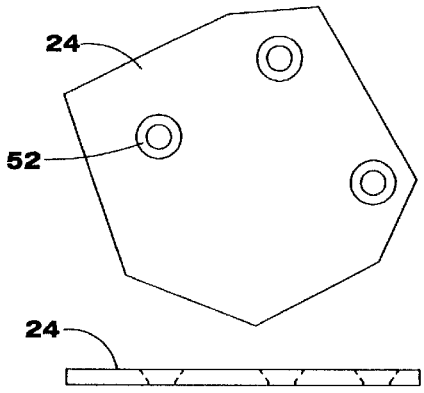
FIG. 3 is a top and side view of the cover plate FIG. 4 s a top view of the temperature regulator with the cover plate, retaining screws, adjusting screw and the rotating plate in phantom.
Figure 4:
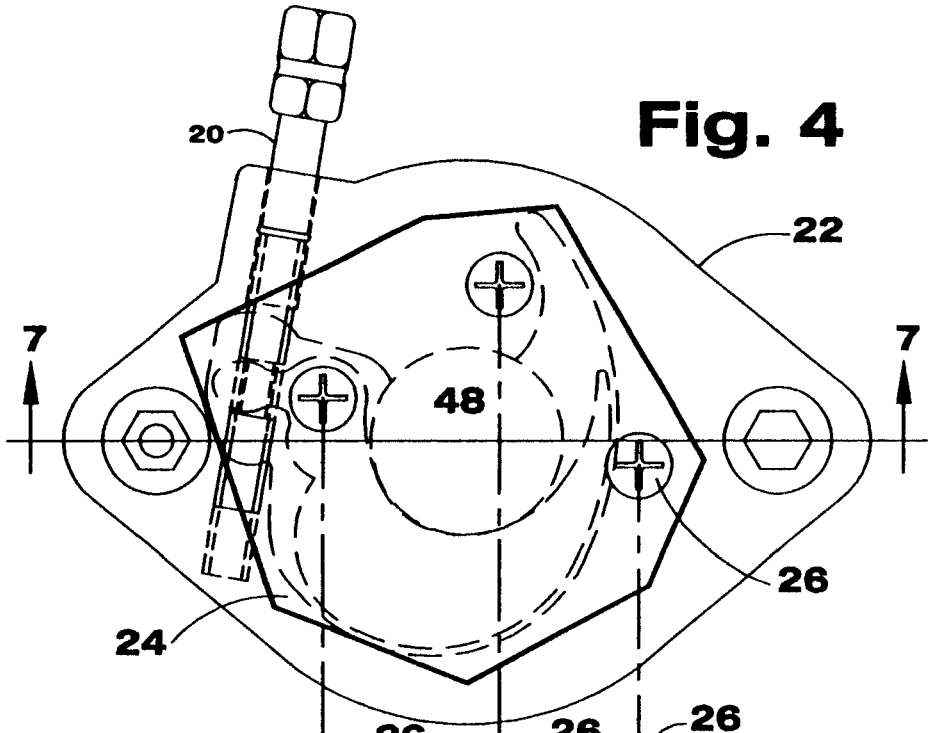
Figure 5:
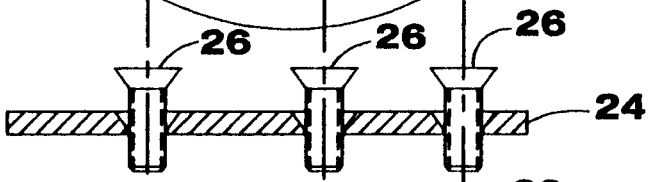
FIG. 5 is a side view of the cover plate with the retaining screws.
Figure 6:
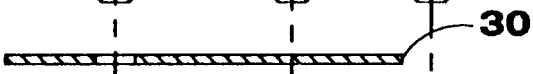
FIG. 6 is a side view of the rotating plate.
Figure 7:
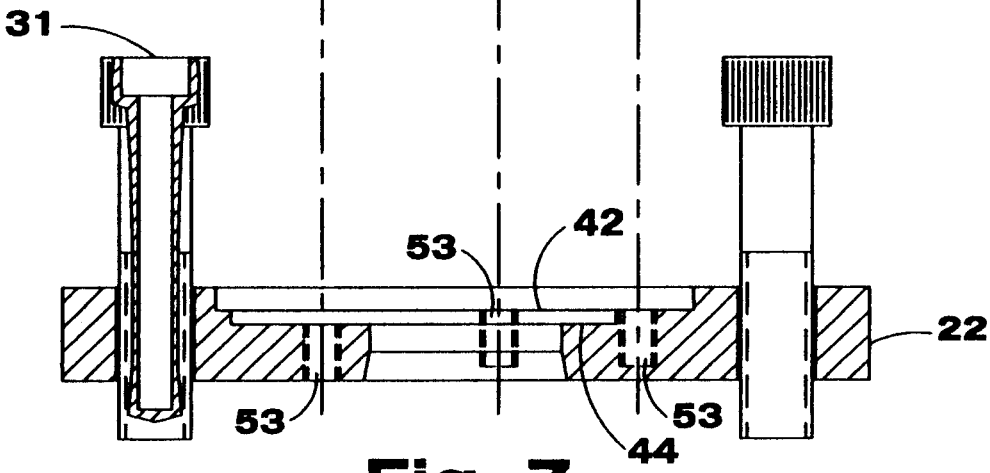
FIG. 7 is a sectional view along line seven showing the rotating plate surface, the cover plate surface the mounting bolts, one modified for the temperature gauge and the cover plate retaining bolt threaded holes.
Figure 8:
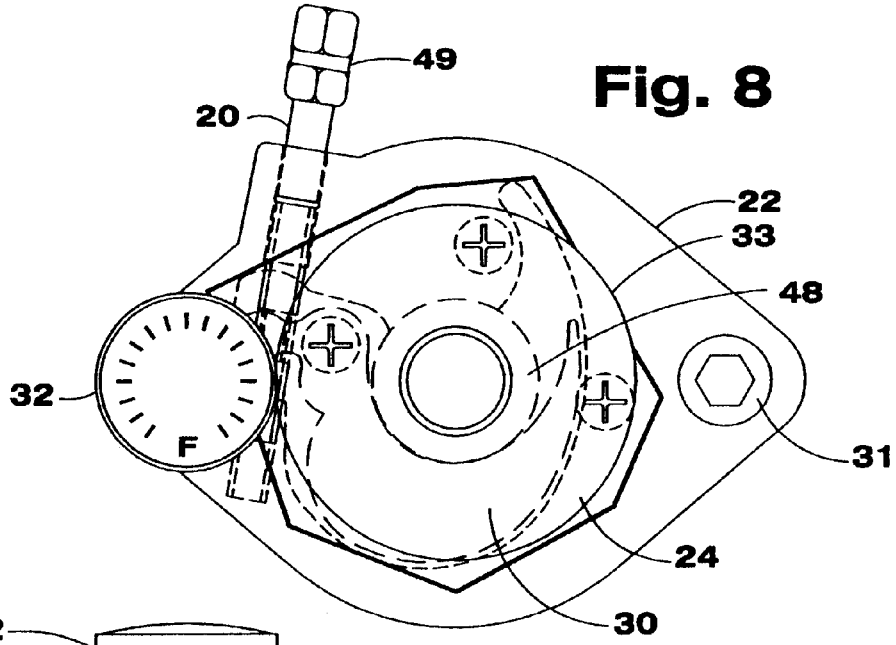
FIG. 8 is a top view of the temperature regulator with the thermostat housing in place, the retaining bolts, temperature gauge and adjusting screw, also show in phantom are the rotating plate, cover plate and cover plate retaining screws.
Figure 9:
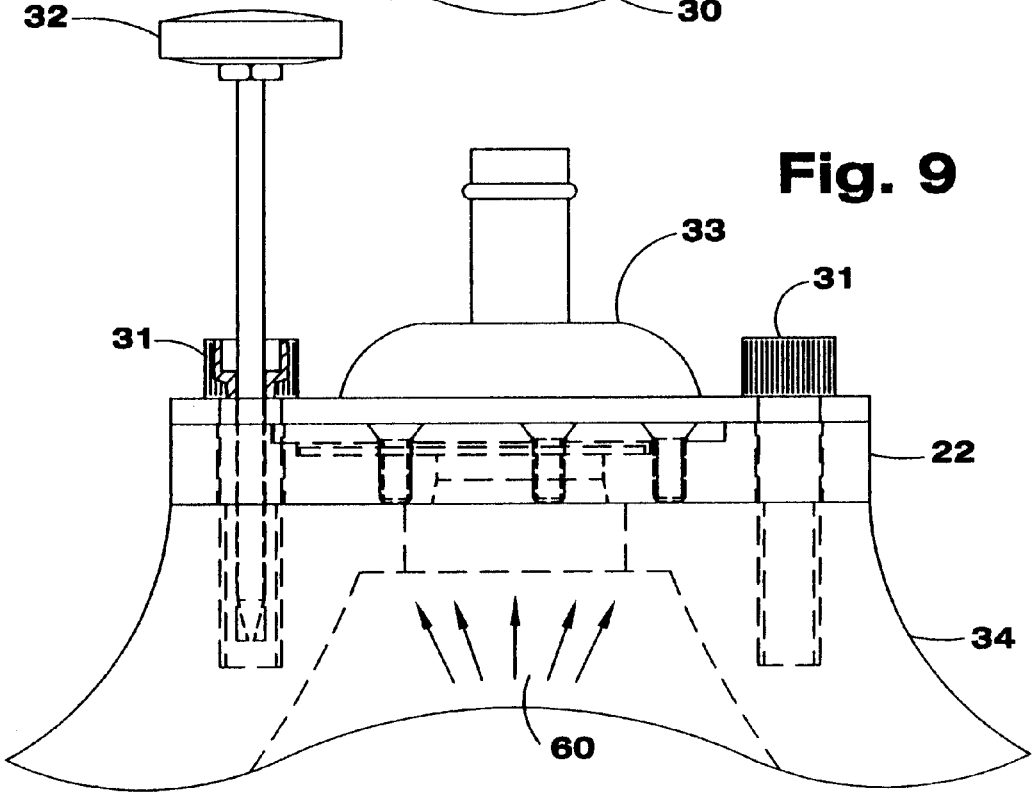
FIG. 9 is a side view of the temperature regulator in place on a typical intake manifold showing the thermostat housing, the mounting bolts partially in phantom, the temperature gauge, partially in phantom and the cover plate, cover plate retaining screws and rotating plate in phantom.
Figure 10:
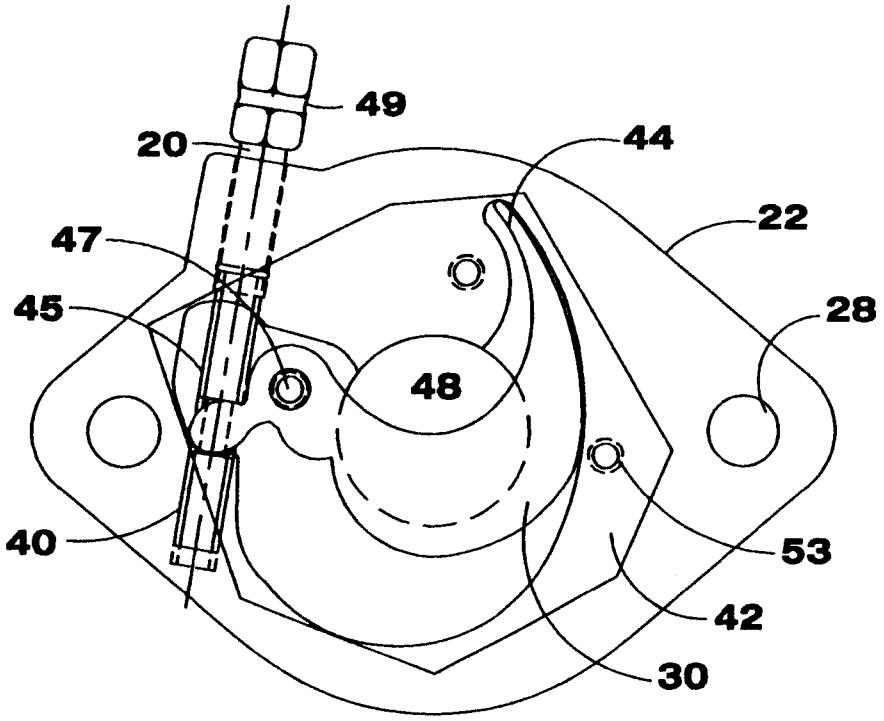
FIG. 10 is a top view of the temperature regulator with the cover plate removed showing the position of the adjusting screw when the rotating plate is rotated over the main orifice which is shown partially in phantom.

20 adjusting screw
22 regulator housing
24 cover plate
26 cover plate retaining screws
28 mounting holes
30 rotating plate

31 mounting bolt drilled for gauge
32 thermometer gauge
33 thermostat housing
34 intake manifold
35 o-ring seal groove
36 rotating plate surface
37 0-ring seal
38 adjustment screw threads
40 adjustment threads in housing
42 housing cover plate surface
44 housing recess for rotating plate
45 actuating knob for rotating plate
47 pivot hole for rotating plate
48 main coolant orifice
49 groove for remote cable hookup
53 taped holes for retaining plate screws
60 coolant flow

ILLUSTRATIVE SPECIFIC EMBODIMENT

In the accompanying drawing which forms a part of this invention the main body of the present invention is indicated in general by the numeral 22 which houses the adjusting mechanism. The housing 22 incorporates mounting holes 28 and is comprised of an adjusting blade 30, with an actuating knob 45, two recess one for the adjusting blade 44 and one for the cover plate 42 the adjusting screw 20 and a threaded hole 40. The adjusting screw 20 contains a machined groove 49 for a remote cable hook up, a machined groove 36 for the o-ring seal 37 to prevent coolant from leaking out of the housing 22 and a groove 36 for the adjusting blade 30. The adjusting screw 20 is utilized to actuate the adjusting blade 30 which when actuated will cover a portion of the main coolant orifice 48 in the housing 22. By adjusting the amount of coolant flow to and from the radiator the temperature can be regulated as desired. The adjusting blade 30 is held in place on the adjusting screw groove 36 by the cover plate 24 which is secured to the housing by three retaining screws 26. One of the retaining screws 26 also acts as the pivot axis 47 for the adjusting blade 30.The temperature regulator 22 fits between the thermostat housing 33 and the intake manifold 34 of an engine and takes the place of thermostat or a restrictor plate. It is secured in place using the holes in the intake manifold. One of the mounting bolts 31 is modified to accept a temperature gauge 32 so the engine operating temperature can be regulated accurately. It is apparent that the present engine temperature regulator provides a convenient and safe way of adjusting engine-operating temperature when the vehicle is at rest or during a race. While the invention has been, described by reference to an illustrative embodiment, it is not intended that the novel device be limited thereby, but that modifications thereof are intended to be included as falling within the broad spirit and scope of the foregoing disclosure, the following claims and the appended drawings.

What is claimed is:

1. In a liquid cooled internal combustion engine having a radiator through which liquid is circulated from a hose having a circular liquid passage orifice of specified diameter, the temperature of the engine after being fully warmed up having a minimum value when the orifice is unobstructed and is fully open, the engine temperature increasing as the opening in the orifice is restricted and decreased, the improvement which comprises:

an internal rotating blade in slidable engagement with the orifice which can assume any position with respect to the orifice between a minimum position at which the rotating blade produces a minimum restriction of the orifice and a maximum position at which the rotating blade produces a maximum restriction of the orifice; and manually operated means connected to the rotating blade to place the rotating blade in any desired position between minimum and maximum positions.

2. The improvement of claim 1 wherein said means includes an adjusting screw attached at one end to the rotating blade, the other end attached to a cable being disposed remotely.

3. The improvement of claim 2 wherein the position of the rotating blade being determined by the suitable rotation of the adjusting screw.

4. In a liquid cooled internal combustion engine having a radiator through which liquid is circulated from a hose having a circular liquid passage orifice of specified diameter, nominally about one inch, the temperature of the engine after being fully warmed up having a minimum value when the orifice is unobstructed and is fully open, the engine temperature increasing as the opening in the orifice is restricted and decreased, the improvement which comprises:

an internal rotating blade in a slidable engagement with the orifice which can assume any position with respect to the orifice between a minimum position at which the rotating blade produces a minimum restriction of the orifice and an engine operating temperature of about 160 degrees and a maximum position at which the rotating blade produces a maximum restriction of the orifice and an engine temperature of about 260 degrees; and manually operated means connected to the rotating blade in any desired position between minimum and maximum positions, said means including, a manually rotatable adjusting screw at one end of the rotating blade, the other end of the adjusting screw having a remote cable attached, and being disposed remotely, the position of the rotating blade being determined by the suitable rotation of the cable.

* * * * *